US006941683B2

(12) United States Patent
Freed

(10) Patent No.: US 6,941,683 B2
(45) Date of Patent: Sep. 13, 2005

(54) LACING SYSTEM

(76) Inventor: Anna B Freed, 185 E. 85th St. Apt. 2-L, New York, NY (US) 10028

( * ) Notice: Subject to any disclaimer, the term of this patent is extended or adjusted under 35 U.S.C. 154(b) by 137 days.

(21) Appl. No.: 10/691,179

(22) Filed: Oct. 21, 2003

(65) Prior Publication Data

US 2004/0078999 A1 Apr. 29, 2004

Related U.S. Application Data

(63) Continuation-in-part of application No. 10/098,218, filed on Mar. 14, 2002, now abandoned, which is a continuation-in-part of application No. PCT/US01/28664, filed on Sep. 14, 2001.

(60) Provisional application No. 60/355,287, filed on Feb. 6, 2002.

(51) Int. Cl.[7] ..... A43C 11/00

(52) U.S. Cl. ..... 36/50.1; 24/712; 24/712.1

(58) Field of Search ..... 36/50.1, 50.5; 24/712, 712.1–712.9, 713.1–713.9

(56) References Cited

U.S. PATENT DOCUMENTS

| | | | | | |
|---|---|---|---|---|---|
| 75,702 | A | | 3/1868 | Rice | |
| 171,274 | A | * | 12/1875 | Edmister | 24/712.4 |
| 317,528 | A | | 5/1885 | Forbes | |
| 395,768 | A | | 1/1889 | Brown | |
| 961,711 | A | | 6/1910 | Bredenberg | |
| 1,088,067 | A | | 2/1914 | Forbes | |
| 2,266,083 | A | | 12/1941 | Rzepa | |
| 3,279,015 | A | * | 10/1966 | Henning | 24/712.2 |
| 4,081,916 | A | | 4/1978 | Salisbury | |
| 4,999,889 | A | | 3/1991 | LeCouturer | |
| 5,027,482 | A | | 7/1991 | Torppey | |
| 5,345,697 | A | | 9/1994 | Quellais | |
| 5,353,483 | A | | 10/1994 | Louviere | |
| 5,357,691 | A | * | 10/1994 | Hyde et al. | 36/54 |
| 5,469,640 | A | | 11/1995 | Nichols | |
| 5,537,763 | A | | 7/1996 | Donnadieu et al. | |
| 5,755,044 | A | * | 5/1998 | Veylupek | 36/50.1 |
| 6,510,627 | B1 | * | 1/2003 | Liu | 36/50.1 |
| 6,513,211 | B1 | * | 2/2003 | Fisher | 24/712 |
| 2003/0041476 | A1 | * | 3/2003 | Liu | 36/50.1 |
| 2003/0041477 | A1 | * | 3/2003 | Liu | 36/50.1 |

* cited by examiner

*Primary Examiner*—M. D. Patterson

(57) ABSTRACT

A lacing system having a lace loop that forms multiple segments that extend from a strap and criss-cross each other in an adjustable opening. The lace is threaded through eyelets of a sneaker, in such a manner that, a single arcuate pull on the strap(s), causes the multiple lace segments to move through the eyelets of the sneaker opening in unison, so that the entire length of the opening contracts simultaneously. This pull also lifts the entire arch area, thus providing better support. The lace segments converge at the strap(s), near the ankle, thus providing better support at the ankle. Additional lace segments could be disposed above the arch to provide better arch support. A strap or fastening member may attach to the sneaker by either a ratchet buckle, clasp, hook, snap, clamp, or locking tape such as hook-and-loop. The sneaker opens to its' maximum width, automatically when the user steps out.

20 Claims, 7 Drawing Sheets

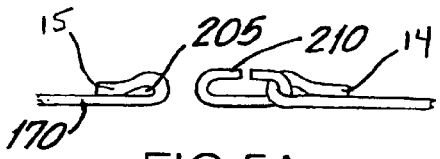
FIG.5A
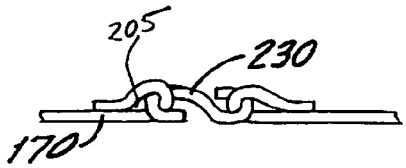
FIG. 5B
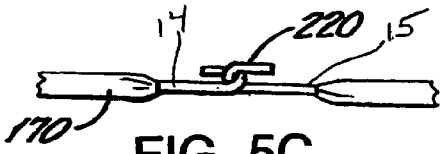
FIG. 5C
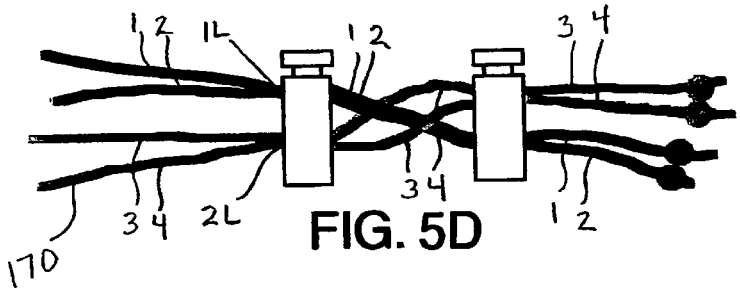
FIG. 5D
FIG. 5E
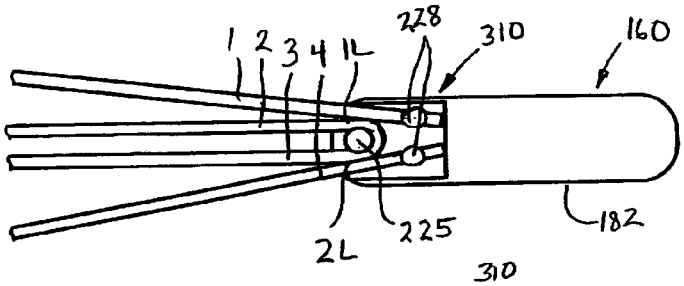
FIG. 5F
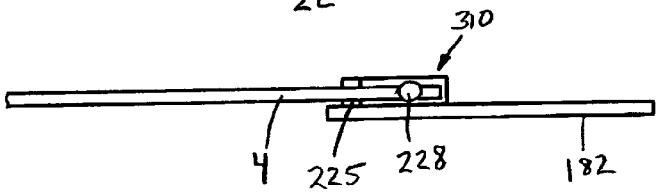

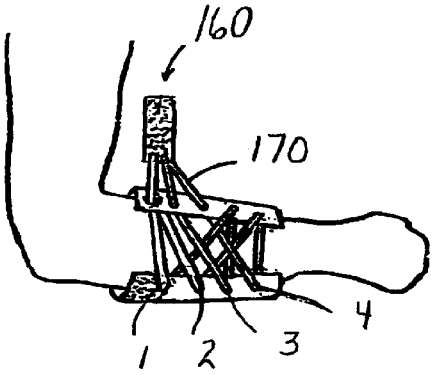
FIG. 8A
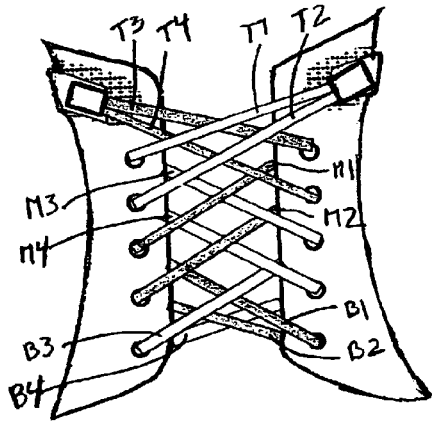
FIG. 8C
FIG. 8B
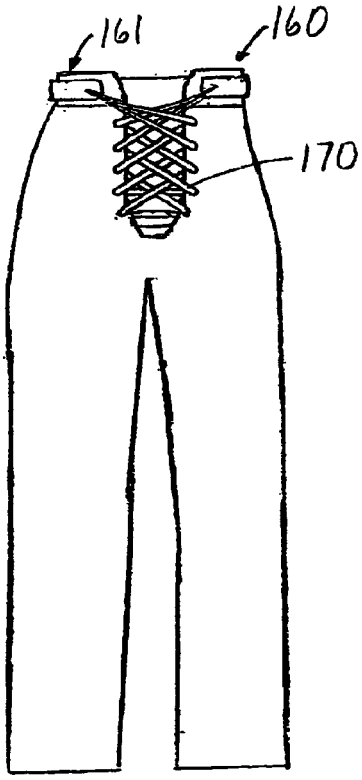

LACING SYSTEM

This is a Continuation-In-Part application of U.S. application Ser. No. 10/098,218 filed Mar. 14, 2002, now abandoned the disclosure of which is hereby fully incorporated by reference, which is a Continuation-In-Part application of international application # PCT/US01/28664 filed Sep. 14, 2001, the disclosure of which is hereby fully incorporated by reference, which entered the U.S. National stage as application Ser. No. 10/089,633 filed Mar. 28, 2002. This application is related to Provisional Patent Application Ser. No. 60/355,287 filed Feb. 6, 2002. The prior art of U.S. application Ser. No. 10/098,218 filed Mar. 14, 2002, now abandoned is included in this application.

BACKGROUND OF THE INVENTION

1. Field of Invention

The present invention relates to the manner in which laces traverse the adjustable opening of sneakers for fastening. More generally, this invention relates to a lacing system which, in addition to fastening shoes, can be used to fasten articles of manufacture such as corsets, garments, orthopedic devices, or luggage etc.

2. Description of the Related Art

To tightly fasten conventional sneakers the user crisscrosses and pulls on the two (2) lace ends at each eyelet pair, starting at the bottom eyelets, until he reaches the top eyelets, after which he makes a bow knot to secure the shoe. In this manner, the laces have been tightened to provide a snug fit. Of course, some users will not bother with tightening the laces at each eyelet pair, and, in this situation, the sneaker does not provide as snug of a fit. To remove the sneaker, the user must first untie the bow knot, and then pull apart the lace segments, at the eyelet pairs, to open the sneaker wide enough for the foot to be removed. This is time consuming, cumbersome, and requires that the user to have the know-how and dexterity to tie bow knots. Additionally, current art lacing systems have other disadvantages such as they do not maintain their tension and are not safe because the bow knots often become undone.

In Forbes (U.S. Pat. No. 1,088,067, issued Feb. 24, 1914), the lace segments do not crisscross each other in the boot opening. Instead, the lace traverses back and forth and from top to bottom, and thus, (since the lace segments do not criss-cross in the opening (or slit), the shoe does not provide adequate support for the users foot. Additionally, the opening has a lace segment disposed horizontally across the top of the opening or slit. This segment limits the width of the opening, making it difficult for the user to insert or remove his foot, and thus Forbes suggests having two (2) openings or slits "the dual arrangement also provides a larger opening than would a single slit, thus maximizing the ease and comfort with which the shoes may be put on and off". The present invention however, has a gap on top of the opening, which creates additional room for the users foot to be removed or inserted. Also in Forbes (U.S. Pat. No. 1,088,067, issued Feb. 24, 1914), the lace segments extend from the bottom of the boot, across the opening, directly to the fastener. These types of segments, which are not guided by the eyelets on the sides of the opening, are not safe, and further weaken the lacing for the boot.

SUMMARY OF THE INVENTION

Accordingly, it is an object of the present invention to provide a lacing system which is easy to apply to a shoe, inexpensive, and easy to manufacture, strong, durable, versatile, reliable, and easy for the user to operate.

It is further an object of the present invention to provide for a lacing system which can easily be placed on shoes by a shoe manufacturer with little or no modification to the shoe.

It is another object of the present invention that it be independent of the shoe and be able to be purchased as an after market item to be put on the shoe entirely by the consumer. Thus, giving the user the benefit of installing the lacing system of the present invention on almost any of his laced shoes and also giving him the option of using the (matching) laces that came with the shoes.

It is a further object of the present invention to provide for a lacing system which is easy to use.

It is another object of the present invention to provide a lacing system that provides equal tension along the length of the opening and can accommodate different shaped feet.

It is another object of the present invention to provide for a lacing system which immediately opens wide so the the user can easily step out and back in.

It is another object of the present invention to have a large opening when unfastened so the user can easily insert or remove the item.

It is another object of the present invention to provide for a lacing system that opens and closes instantly for tri-athletes, or people in a hurry.

It is another object of the present invention to provide for lacing system having laces which are replaceable.

It is another object of the present invention to provide for a lacing system that can be used by young children, to give them independence, before they know how to tie bow knots.

It is yet another object of the present invention to eliminate repeated retying of bow knots, to improve appearance, and to increase safety.

It is yet another object of the present invention to provide for laces that don't wear out readily, since there are no bow knots that are repeatedly tied and untied and/or dragged along the ground causing wear on the lace.

It is another object of the present invention to provide for a lacing system that can easily be operated using only one hand or by seniors who are physically impaired (e.g., users who have arthritis, Alzheimer's, or can't bend down for long periods of time due to obesity or heart disease etc.) Also, users having difficulty reaching the fastener on the outside of the shoe would benefit, because the fastener could be disposed on the arch side (or the middle) of the sneaker.

It is another object of the present invention for the laces of the lacing system to lift the side(s) at two or more eyelets concurrently, for better support.

It is yet another object of the present invention to provide better support at areas where it is needed, such as the ankle and/or the arch.

It is yet another object of the present invention to enable the user to choose, when he puts on his shoe, whether he wants more or less ankle support.

It is yet another object of the present invention for the lacing system to be safe. Since there are no bow knots to come untied, there are no loose laces to trip over or come undone.

It is yet another object of the present invention to maintain it's tension all day.

It is yet another object of the present invention to provide for a lacing system that maintains it's adjustment. For example, after the user adjusts his shoe the first time, he can merely hook and unhook it each time he takes it on and off, requiring no further adjustments in subsequent wearings.

It is another object of the present invention to provide for a lacing system that can easily be used by athletes for different sports, that require their shoe closure to have strength, durability, reliability, speed, and different fits.

It is yet another object of the present invention to be versatile and customizable and provide for a variety of embodiments to benefit different population segments, a variety of activities and sports, and other individual needs.

It is yet another object of this invention to provide for a lacing system which has application on many types of footwear (sandals, boots, slippers, sneakers, skates etc.) as well as many other manufactured articles across many industries, i.e., luggage, orthopedic devices, corsets, and garments, etc.

The lacing system of the present invention provides: 1) the comfort, fit, and look of laces; 2) the ease, speed, and safety of locking tapes such as hook-and-loop fasteners; 3) the reliability, durability, and strength of a ski boot ratchet buckle; 4) and other benefits that are not available in any other lacing system.

BRIEF DESCRIPTION OF THE DRAWINGS

The above and still further objects, features and advantages of the present invention will become apparent upon consideration of the following detailed description of the specific embodiment thereof, especially when taken in conjunction with the accompanying drawings:

FIG. 5A shows the ends of a lace having two (2) holes which hook onto a hook;

FIG. 5B shows the holes at the lace ends connected by an S-hook;

FIG. 5C shows a lace with aglets (or lace ends) having a hook shape and hooking onto each other;

FIG. 5D shows two (2) cord-locks, side by side, with the four (4) lace segments criss-crossed between the cord-locks for added strength;

FIG. 5E shows a top view of a movable fastener strap and retaining device with a lace wrapped around a rod and two (2) knotted lace ends;

FIG. 5F shows a side view a movable fastener strap and retaining device of FIG. 5E;

FIG. 8A shows the lacing system of the present invention with one (1) movable fastener and four (4) lace segments on an arm bandage;

FIG. 8B shows the lacing system of the present invention having to (2) movable fasteners on a pair of pants; and FIG. 8C shows the lacing system of the present invention having two (2) lace loops and two (2) hook and loop fasteners on a body brace.

DETAILED DESCRIPTION OF THE PRESENTLY PREFERRED EXEMPLARY EMBODIMENTS

Figure 1A:
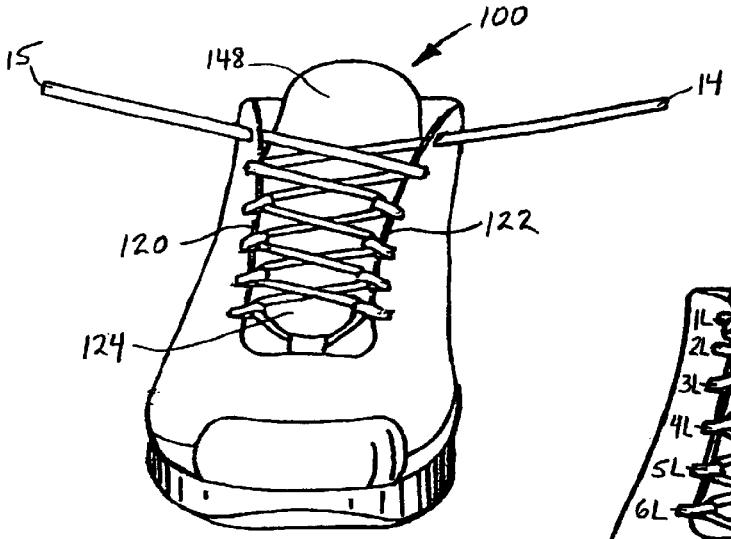
PRIOR ART FIG.1A
FIG. 1A is a front view of a right sneaker which is conventionally laced and untied.
Figure 1B:
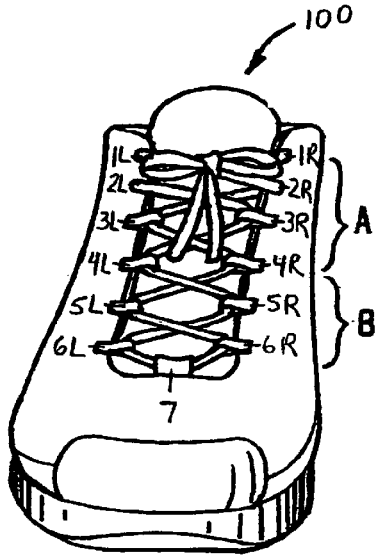
PRIOR ART FIG.1B
FIG. 1B is the sneaker of FIG. 1A with the laces tied.

FIGS. 1A–B illustrate a conventionally laced sneaker 100, untied and tied respectively. The same number of eyelets are on either side 120, 122 of the adjustable opening 124. There are four pairs of eyelets over the instep (R=right, L=left) 3R,3L; 4R,4L; 5R,5L; 6R,6L There are two pairs of eyelets near the ankle 1R,1L; 2R,2L, which are placed there for additional support.

For the sake of brevity in the drawing illustrations, only the right sneaker 110 of the present invention is shown and discussed throughout this disclosure, however, one skilled in the art will readily recognize that the lacing system can be easily incorporated into a left sneaker (and other articles of footwear such as sandals, boots, skates, and slippers etc.). Two (2) basic embodiments are disclosed. The embodiments of the present invention with one (1) movable fastener are illustrated in FIGS. 2A–4F, 6A–61,8A and those with two (2) movable fasteners are illustrated FIGS. 7A–7H,8B–C. The eyelets could be holes, loops, hooks, etc. and there could be more or less than the examples given. The sneakers in FIGS. 2A–B also have four (4) pairs of eyelets 3R,3L; 4R,4L; 5R,5L; 6R,6L over the instep, on the sides of the adjustable opening 124. Two additional eyelet holes 1R, 2R are on the top of the right (or arch) side 130, of the sneaker. A strap or movable fastener 160, has two movable eyelet holes 1L,2L through which the lace 170, is threaded. Eyelets 1L,2L move to the left side when the sneaker is fastened. A tongue 148 is of conventional structure and bridges the adjustable opening 124. The lace 170 forms four (4) lace segments (1,2,3,4) that radiate, extend, attach, or exit from movable eyelet holes 1L, 2L in strap 160. Segment 1 extends from 1L to SR; segment 2 extends from IL to 6R; segment 3 extends from 2L to 5R; and segment 4 extends from 2L to 6R.

Figure 2A:
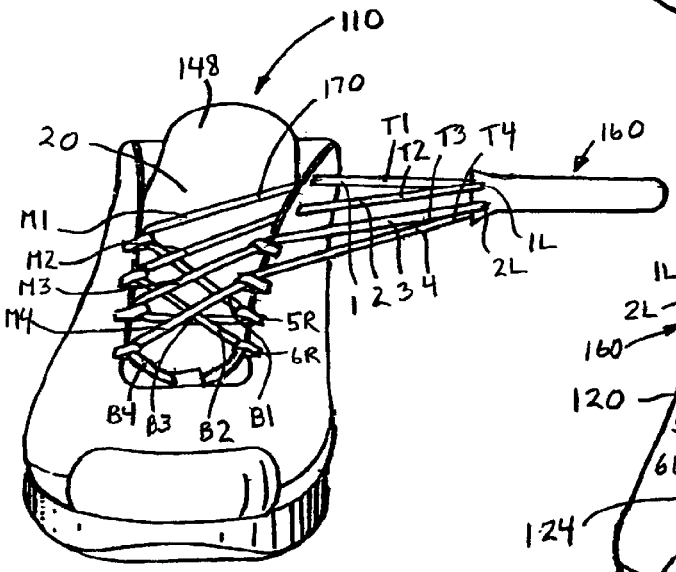
FIG. 2A is a front view of a right sneaker having the lacing system of the present invention and opened.
Figure 2B:
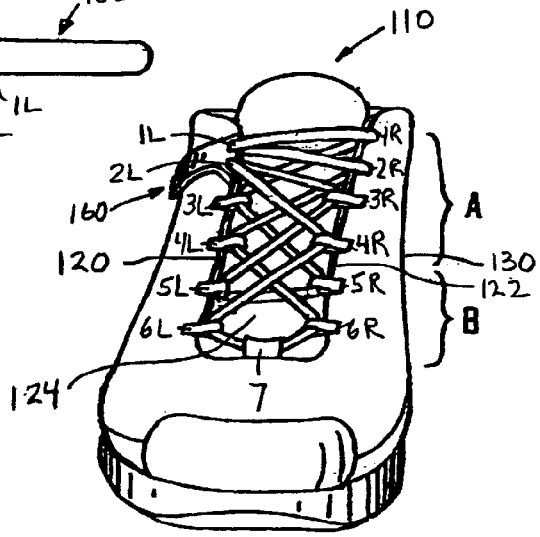
FIG. 2B is the sneaker of FIG. 2A fastened.

The four (4) lace segments (1,2,3,4) are further divided into top, middle, and bottom portions or segments. Segments T1,T2,T3,T4 define the "top segments" exiting from eyelets 1L,2L and going into eyelets 1R,2R,3R,4R. Segments T1,T2,T3,T4 continue into segments M1,M2,M3,M4 respectively, which define the "middle segments" and traverse diagonally across the adjustable opening 124 in a downward direction from eyelets 1R,2R,3R,4R to eyelets 3L,4L,5L,6L respectively. Segments M1,M2,M3,M4 then continue into segments B1,B2,B3,B4 respectively which define the"bottom segments", and traverse the adjustable opening 124. The "bottom segments" traverse from eyelets 3L,4L,5L,6L to eyelets 5R,6R. During this traverse, the "bottom segments" and the "middle segments" cross each other in the adjustable opening 124 again. The "middle segments" may overlap the "bottom segments" (or vise-versa). Since eyelets 3L is lower than eyelet 1R, the top segment M1 is diagonally disposed across the opening 124, and M1 creates an angular gap 20, with side 120 of the opening. This gap 20, creates more room for the user to insert (or remove) his foot from the sneaker when it is opened. This gap 20, is covered by the top segments T1,T2,T3,T4 when the sneaker is in fastened position. The adjustable opening is above the instep. The top of the opening A, is near the ankle, and the bottom of the opening B, is near the toes. The lacing system of the present invention can have one or more lace loops, having different benefits (e.g., a single lace loop might install more readily, two lace loops might adjust faster). In FIGS. 2A–B, the four (4) lace segments 1,2,3,4 are formed from one (1) lace loop and extend from the strap 160 at eyelet holes 1L, 2L and thread through eyelets 1R,2R,3R,4R and then into eyelets 3L,4L,5L,6L respectively and then meet at eyelets 5R,6R.

Current art sneakers in FIGS. 1A–B must be pulled at each eyelet pair to provide a snug fit. Two additional pairs of eyelets (usually holes) may be positioned near the ankle A, to enable more segments to cross near the ankle for more support, (since the ankle area is subject to additional movement and stress). Each time a lace segment turns though an eyelet, friction causes the effect of the pull to be significantly diminished. The right lace segment in FIG. 1A turns at eyelets 2L,3R,4L,5R, and 6L (i.e., 5 turns). The lace 170, has two (2) ends 14,15. A pull at end 14, near eyelet 1R, has very little effect after the first turn (i.e., little effect on the eyelets 3R, 4L,5R, and 6L) and the bottom B, of the opening, does not contract. In FIGS. 2A–B however, each of the four (4) segments 1,2,3,4 turns at only one eyelet (1 turn) when the user starts to pull the strap. Segment 1 turns at 3L, segment 2 turns at 4L, segments 3 turns at 5L, and segment 4 turns at 6L Therefore, a pull on the strap, which is connected to the four (4) segments, contracts the adjustable opening at the bottom B instantly, with substantially equal tension, since all 4 segments pull in unison at the bottom eyelets 5R,6R (after only 1 eyelet turn in each segment). The friction in prior art lacing is further increased by segments which cross over and under each other in the adjustable opening. With the lacing system of the present invention however, he segments M1,M2,M3,M4 may be positioned so that they are all layered above (or all below) segments B1,B2,B3,B4, to further reduce friction, and thus further facilitate instantaneous opening and closing of the adjustable opening 124 (i.e., since the middle segments are at a different level than the bottom segments). The top segments are always layered above and cross the middle segments, further minimizing the friction from the segments that criss-cross the adjustable opening.

When the user steps in and out of the shoe, the opening 124, near the top A opens a lot more than the remainder of opening 124 near the bottom B, which opens relatively little. The lacing system of the present invention also opens very wide at the top A, and less at the bottom B, as required by the natural motion of the user when removing or inserting his foot from and to the sneaker. The gap 20, creates additional room for the user to remove (or insert) his foot. The lacing system of the present invention may have of one or more lace loops. The laces loops can be closed or open. The closed loop has a substantially continuous lace; whereas an open includes part of the sneaker or article of manufacture, so that the lace is not continuous, as shown in FIG. 6C. In the embodiments of the lacing system of the present invention, the laces can be easily adjusted to be looser on top A, and tighter on the bottom B, or visa versa to accommodate a variety of foot structures (i.e., high or low arches or instep, swollen, fat or thin ankles etc.). The segments of the lacing system of the present invention criss-cross each other in the adjustable opening providing better support and improved appearance (no unsightly bow-knots).

The movable fastener of the present invention need only be pulled (or adjusted) once for essentially the entire opening of the sneaker to contract instantly with substantially equal tension (i.e., a single arcuate pull on the strap 160, results in all four (4) lace segments contracting essentially all the criss-crossing segments of the adjustable opening 124 at once). The four (4) lace segments of the present invention may also provide additional support (extra lace segments) near the ankle A, because all four (4) segments converge at eyelets 1L,2L of the movable fastener 160 near the ankle. With fastening the sneaker of the present invention, the initial pull on the movable fastener by the user (in direction V) causes the criss-crossing segments of the bottom part of the opening B, to contract. Continued upward pulling, lifts and tightens the arch area 130, then continued arcuate pulling towards the fixed fastener side 120, causes the top part of the opening A, to contract with substantially equal tension on all segments along the entire opening 124, until the sneaker is fastened. Therefore, with one substantially semi-circular motion or pull, the entire opening 124 of the sneaker is contracted and snugly fastened! In reverse, the sneaker opens immediately at both the top A, and the bottom B, when the user removes his foot from the sneaker. To fasten the sneaker, the user can choose to engage the movable fastener to a fixed fastener that is higher (or nearer the ankle), to increase ankle support and also cover or close the gap. Since there may be more than one fixed fastener position, the user can change the ankle support when he desires. Of course, the lace loops can be configured, by someone skilled in the art, to form additional criss-crossing segments below the bottom segments, and these configurations are all included within the spirit and scope of the present invention.

Figure 3A:
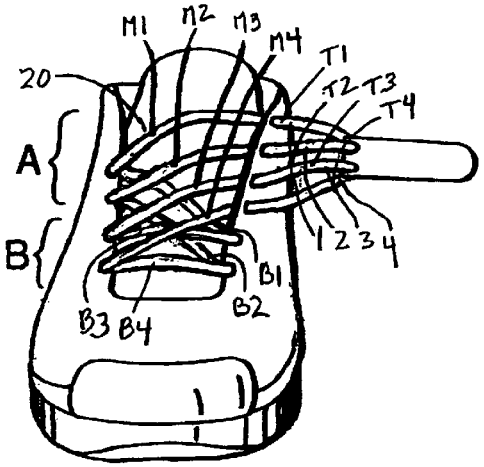
FIG. 3A is a front view of a right sneaker of the present invention showing the slack in all the lace segments when it is opened.
Figure 3B:
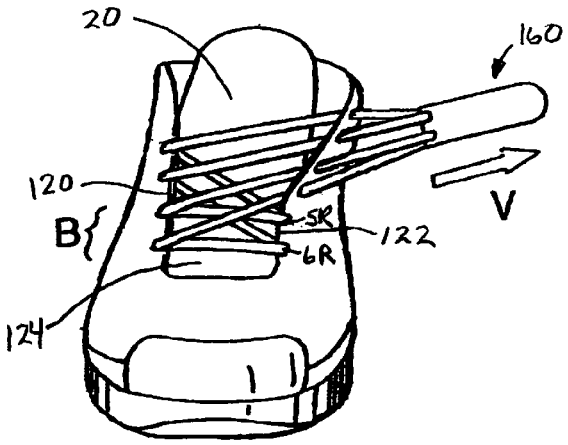
FIG. 3B is the sneaker of FIG. 3A wide open, before the user starts to contract the opening.

Referring to FIGS. 3A–B, when the user pulls the strap in the direction of arrow V, segments 1 and 3 pull at eyelet 5R and segments 2 and 4 pull at eyelet 6R simultaneously, hence contracting the area around the bottom B, of the opening 124. At the start of the pull, the bottom of the opening B, is therefore contracted, as the user continues to lift, pull, and rotate the movable fastener towards the fixed fastener, the four (4) lace segments contract the top A of the opening 124.

Figure 3C:
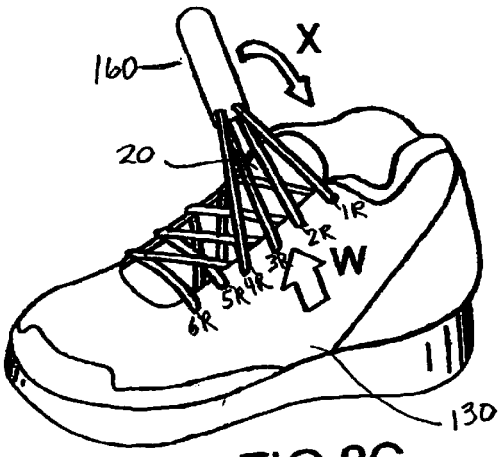
FIG. 3C is a side view sneaker of FIG. 3A showing the upward pull on the arch produced by the four (4) lace segments when the user pulls the strap.
Figure 3D:
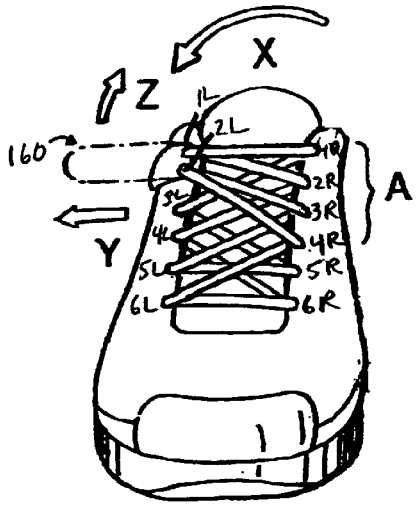
FIG. 3D is the sneaker of FIG. 3A after it has been fastened.

FIG. 3A shows the sneaker in the open position with slack in the lace segments. The sneaker in accordance with the present invention opens to it's maximum width instantly. The single substantially semi-circular motion that tightens and fastens the shoe, is described in greater detail:

1) First the user adjusts the segments (by wiggling, jiggling, or pulling etc.) the strap 160, to eliminate any slack in the lace loop 170, until all four (4) segments are taut.
2) Then the user pulls the strap away from the sneaker, in the direction of arrow V, to contract bottom (or far) part B of the adjustable opening (FIG. 3B);
3) Continued pulling straight up of strap 160, in the direction of arrow W, as shown in FIG. 3C, tightens the sneaker snugly about the arch area 130, because all four top segments T1,T2,T3,T4 pull the arch up, through the eyelets 1R, 2R, 3R, 4R;
4) The user, keeping the lace segments taut, continues to pull the strap or movable fastener 160 towards the fixed fastener in a substantial arc, shown by arrow X, thus contracting the top part A, of adjustable opening 124 (FIG. 3–D);
5) The user continues pulling on strap 160 in the direction arrow Y; and
6) The final motion, in the direction of arrow Z, fastens the shoe depending on the type of fastener used.

The top segments T1,T2,T3,T4 extend from the movable fastener 160 to side 122, the middle segments M1,M2,M3, M4 extend diagonally downward from side 122 to side 120, the bottom segments B1,B2,B3,B4 extend from side 120 back to side 122 again. Top segments T1,T2,T3,T4 cover the gap and cross over segments M1,M2,M3. and bottom segments B1,B2,B3 cross middle segments M1,M2,M3,M4.

Figure 4A:
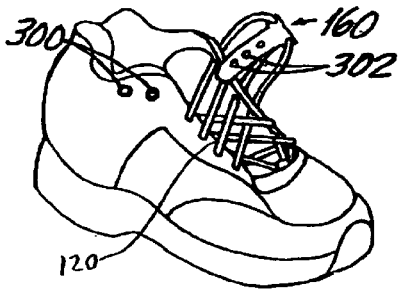
FIG. 4A is an outside view of a right sneaker of the present invention having holes in the strap that hook to the sneaker.
Figure 4B:
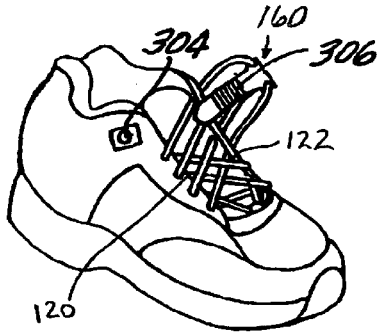
FIG. 4B is an outside view of a right sneaker of the present invention having ratchets on the strap and a ratchet buckle on the sneaker.

FIGS. 4A–F show six (6) different exemplary fastening methods of the embodiments of this invention with one (1) movable fastener. Of course, many other fastening methods may be contrived by those skilled in the art. FIG. 4A shows two (2) fixed fastener hooks 300 on side 120 of the sneaker and eyes 302 on the movable fastener 160. Of course, this could be reversed i.e., the eyes could be disposed on the sneaker (fixed fastener), and the hooks could be on the movable fastener 160 (not shown). The eyes on the sneaker could actually be the eyelets (holes, loops or hooks etc.) thus, eliminating a part and requiring no change to the sneaker. This embodiment may be sold as an after market item, to be retrofitted onto most sneakers or shoes. The hook(s) 300 may be screwed or snapped into eyelets at the top of the adjustable opening, and the laces and fastener could be installed as shown. The user chooses which hook (or eye) to use depending on the ankle support he desires. Attaching the strap towards the top of the shoe, nearer the ankle, provides more support (for sports such as basketball). FIG. 4B shows a buckle fixed fastener 304 on side 120 that engages with the movable fastener having teeth or ratchets 306.

Figure 4C:
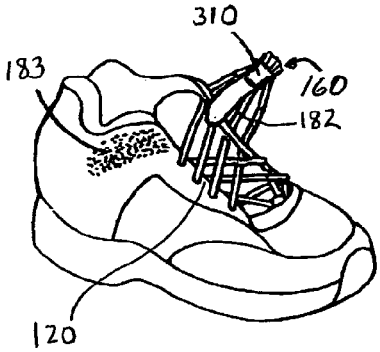
FIG. 4C is an outside view of a right sneaker of the present invention having a hook-and-loop fastener on the underside of the strap and on the side the sneaker.
Figure 4D:
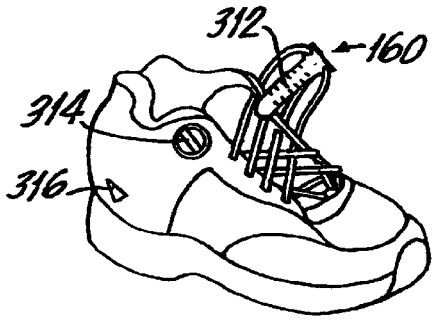
FIG. 4D is an outside view of a right sneaker of the present invention and the strap having two sets of teeth, a holder and a retainer on the sneaker, as disclosed in my other patent incorporated herein by reference.
Figure 4E:
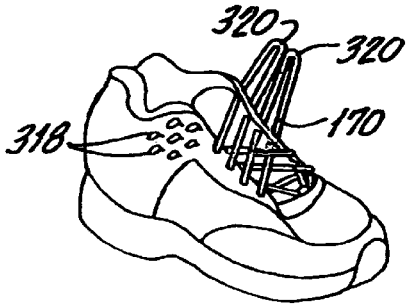
FIG. 4E is an outside view of the right sneaker of the present invention having four (4) lace segments forming two (2) bends or eyes which hook onto the hooks on the side of the sneaker.
Figure 4F:
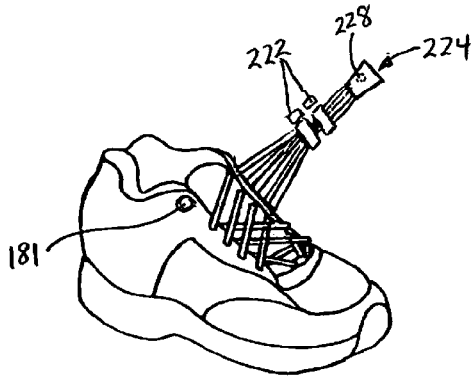
FIG. 4F is an outside view of the right sneaker of the present invention having four (4) lace segments attached to two (2) cord-locks which hook onto a hook on to the side of the sneaker.

FIG. 4C shows a locking tape fastener such as hook-and-loop or hook-and-hook. The hooks 183 may be on side 120 of the shoe and the loops 182 may be on underside of the movable fastener 160 or visa versa. A member 310 retains and covers the knotted ends 228 of the lace. Moving the strap to the top of the shoe nearer the ankle, provides more support. FIG. 4D shows a movable fastener with two sets of teeth as fully disclosed in my PCT patent, application # PCT/US01/28664. The movable fastener 160 has two (2) sets of teeth 312 on one side, and the fastener 314 is attached to side 120 of the shoe. A sleeve 316 may be used to hold the strap 160 end next to the shoe when the strap is fastened. In FIG. 4E hooks 318 are fixed on the outside of side 120 of the sneaker, and the eyes are formed by the bends 320 in the lace. These eyes could alternatively be sewn to each other so that only one eye 320 remains to be hooked (not shown). The eyes 320 could attach to one or more of the hooks 318 on the outside of the sneaker. The hooks closer to the ankle or back of the shoe, may provide more support. This embodiment uses the bends in lace 170 to form the moveable fastener and thus, a part is eliminated. FIG. 4F shows a fastener with two (2) cord-locks 222. The user squeezes the cord-locks 222 to adjust the size of the loops or segments for a tighter or looser fit. The cord-locks hook around the hook 181. The hook 181 could be screwed into the top sneaker hole, making this easy to install on a sneaker as an after market lacing system. This embodiment requires no further adjustment, since after the very first adjustment, the user simply hooks and unhooks the fastener each time he wears the sneaker. The tip 224 and is used to pull the fastener and it is also used to cover knotted ends 228 of the lace and keep them in place.

The lacing system of the present invention is replaceable and adjustable. FIG. 5A shows one of the ways a lace 170 can form a closed loop. The ends 14,15 of each lace 170 can be turned and sewn to itself to form a hole 205. A link member 210 can extend through each hole 205 to form a closed loop. Of course, hole(s) 205 could alternatively be formed within the actual lace 170 (not shown). Numerous holes in the lace provide for a closed lace loop which is adjustable. Link 210 may or may not be connected to the shoe. FIG. 5B shows how the ends could form holes to hook onto an S-hook 230 so the lace then forms a closed loop. Of course, the lace ends could also be attached to strap 160 by a hook or loop, or may be sewn thereto (not shown). FIG. 5C shows how the two (2) ends 14,15 of lace 170 can attach to each other to form a closed loop. The lace ends, or aglets, could have hooks 220, and could hook together. The lace ends 14,15 could also be sewn together, or they could be sewn to the sneaker or to the strap etc. The lace may alternatively be secured to the shoe, the strap, by cord-locks, an eyelet etc. by a hook, sewing, knotting, squeezing or pinching (as with a cord-lock,) etc. FIG. 5D shows two (2) cord-locks 222 that pinch or squeeze the lace 170 and segments 1,2,3,4 are reversed between the cord-locks 222 for an extremely strong hold. The user must move each cord-lock separately to change the size of the loop(s), which tightens or loosens the adjustable opening. FIG. 5E shows a top view of the movable fastener 160 having a retaining member 310. The two (2) ends of lace 170, (at the ends of segments 1 and 4) are knotted 228, thus fixing the size of the loop, Segments 2 and 3 wrap around rod 225. This fastener is illustrated in FIG. 4C FIG. 5F shows a side view of FIG. 5E The underside of this strap 182 could have locking tape (hooks or loops).

FIGS. 6A–I show some alternative embodiments of the lacing system in accordance with the present invention having one movable fastener. The lacing segments may criss-cross over and/or under each other at different angles. The number of lacing segments may vary. The eyelets may be holes and/or loops, etc. and there are a variety of fastening methods. The various configurations of the present invention could influence the flexibility and fit of the shoe. Depending upon the sport or use, different lacing embodiments of the present invention may be preferred.

Figure 6A:
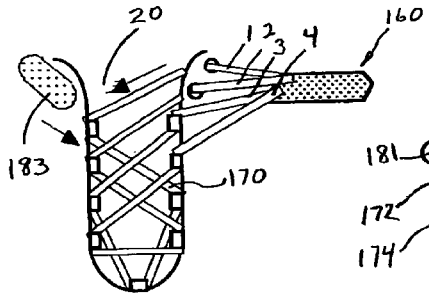
FIG. 6A shows the lacing system having one (1) movable fastener and one (1) lace loop, having a locking tape fastener, and four (4) lace segments.
Figure 6B:
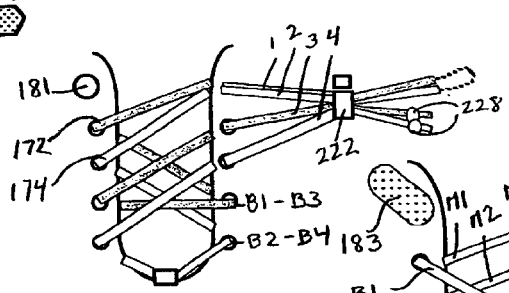
FIG. 6B shows the lacing system, with two (2) lace loops whose sizes are fixed by a cord-lock, and four (4) lace segments.
Figure 6C:
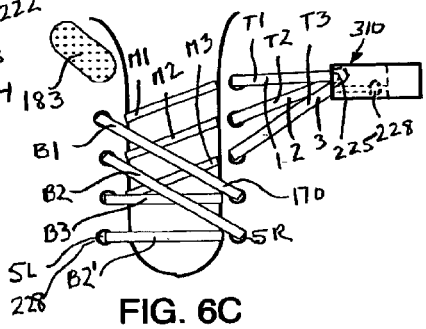
FIG. 6C shows the lacing system, with one (1) open lace loop, and three (3) lace segments extending from a movable fastener.

FIG. 6A shows a single looped lace 170 with four (4) segments 1,2,3,4 exiting from a movable fastener 160. FIG. 6B shows two (2) lace loops 172, 174, whose two (2) ends are knotted 228 to prevent them from pulling out of cord-lock 222 which secures the lace in four (4) places (by pinching or squeezing) to create the loops.

FIG. 6C shows the lacing system of the present invention having one (1) open lace loop that forms three (3) lace segments which extend from the movable fastener. The three segments are divided into three (3) top segments T1,T2,T3, three (3) middle segments M1,M2,M3, and four (4) bottom segments B1,B2,B2',B3. One end is knotted 228 in the retaining member 310, of the movable fastener 160, and the other end is attached (threaded & knotted or sewn etc.) to the sneaker at (or near) eyelet 5L.

Figure 6D:
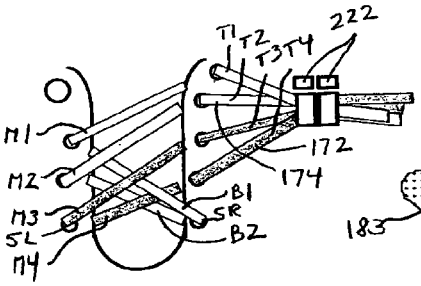
FIG. 6D shows the lacing system, with two (2) lace loops and two (2) cord-locks.

FIG. 6D shows two (2) lace loops 172, 174. One of the loops 172 is shaded to easily distinguish it from the other loop in the drawing figure. Loop 174 has top segments, middle segments, and bottom segments. Loop 172 has only top and middle segments. Segments B1 and B2 meet at eyelet RS. Segments M3 and M4 meet at eyelet 5L In this embodiment, there are four (4) top segments, four (4) middle segments and only two (2) bottom segments.

Figure 6E:
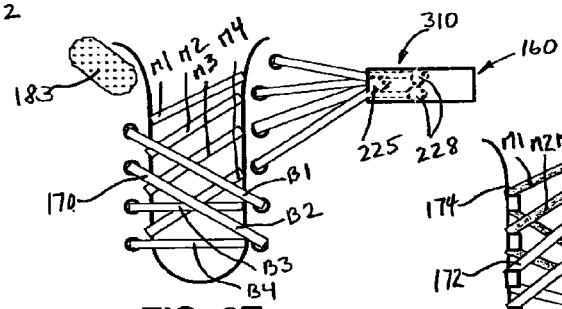
FIG. 6E shows the lacing system, with one (1) lace loop having four (4) segments.
Figure 6F:
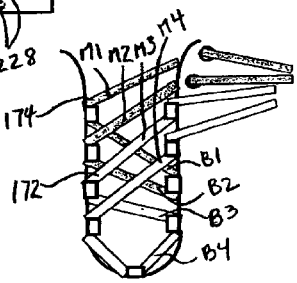
FIG. 6F shows the lacing system, with two (2) lace loops, and four (4) lace segments.

FIG. 6E shows the present invention with one (1) lace loop 170. The two (2) ends of the lace are knotted in the retaining member 310 and bottom segments (B1,B2,B3) cross over middle segments M2,M3,M4). FIG. 6F shows the present invention with two (2) lace loops 172,174 and middle segments (M2,M3,M4) cross over all the bottom segments (B1,B2,B3).

Figure 6G:
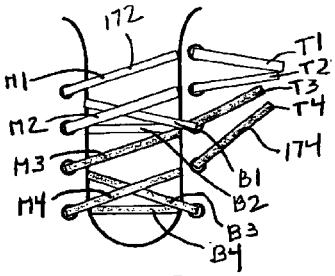
FIG. 6G shows the lacing system, with two (2) lace loops, having four (4) segments, and having an additional segment across the arch area.

FIG. 6G shows two (2) lace loops 172,174 with a lace segment B2 horizontally across the center of the adjustable opening 124.

Figure 6H:
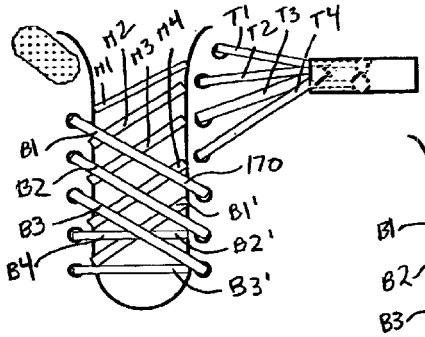
FIG. 6H shows the lacing system of FIG. 6E with an additional pair of eyelets.
Figure 6I:
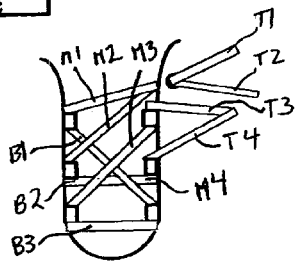
FIG. 6I shows the lacing system, with one (1) lace loop and three (3) pairs of eyelets.

FIG. 6H shows the lacing system of FIG. 6E with an additional pair of eyelets. Since this adjustable opening has more eyelets, there are three (3) additional segments B1', B2',B3' extending from bottom segments B1,B2,B3. FIG. 6I shows one (1) lace loop 170 having four (4) top segments, three (3) middle segments, and three (3) bottom segments. Segment B2 merges into M4.

Figure 7A:
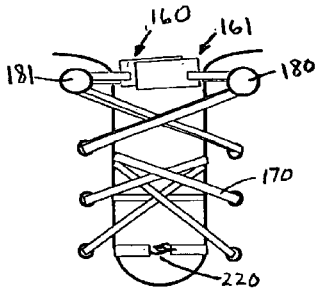
FIG. 7A shows the lacing system of the present invention having two (2) movable fasteners, two (2) lace segments extending from each fastener, and threaded through three (3) pairs of eyelet holes on the sides of the opening in the fastened position.

FIGS. 7A–7G show several embodiments of the lacing system of the present invention having two (2) movable fasteners that would be a part of a manufactured article such as shoes, garments, luggage, orthopedic devices etc. FIG. 7A shows a closed lace loop 170 with the ends hooked together 220. The opening has three (3) eyelets on each side. Two (2) movable fasteners 160,161 wrap around hooks 180,181 and attach to each other by locking tape.

Figure 7B:
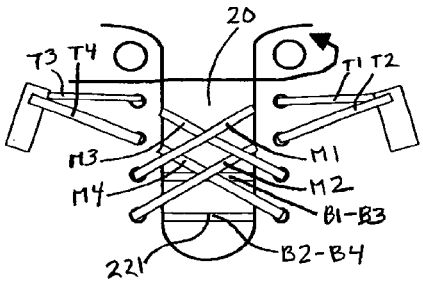
FIG. 7B shows the lacing system of the present invention in the unfastened position, having two (2) lace segments extending from each fastener, and threaded through four (4) pairs of eyelet holes on the sides of the adjustable opening.
Figure 7C:
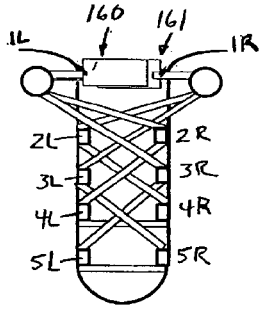
FIG. 7C shows the lacing system of FIG. 7B fastened in the center, and wrapped around hooks, having four (4) pairs of eyelet loops.

FIG. 7B shows an embodiment of the present invention in the unfastened position, having four (4) eyelets per side, one lace loop 170, and a pair of fixed fastener hooks 180, 181 on top and lace ends are sewn together at 221. Segments B1–B2 merge and segments B2–B4 merge. FIG. 7C could be advantageous for basketball players, (or other sports where more ankle support is required), because the double fastener 160, 161 is high in front of the ankle and provides additional support. The lacing system in FIGS. 7A–C can be put on an article of manufacture by the user, as an after market accessory. For example, to apply this lacing system to a shoe, attach the hooks to the top eyelets on the shoe (by screwing, snapping, or riveting etc.), thread the lace through the remaining eyelets and attach the ends as shown. The excess of the lace loop can be cut, and the ends can be knotted, (taped or glued) so that they don't fray. In this manner, this lacing system can be applied to an adjustable opening of almost any laced shoe or article of manufacture as an after market accessory. Once installed, the user has all the benefits of the present invention in his shoe or other article of manufacture.

Figure 7D:
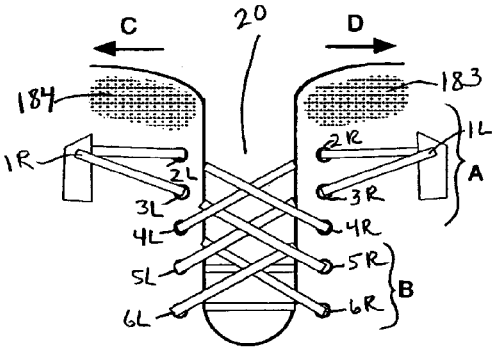
FIG. 7D shows the lacing system of the present invention having two (2) movable fasteners that are hook and loop, and one (1) lace loop in the unfastened position.
Figure 7E:
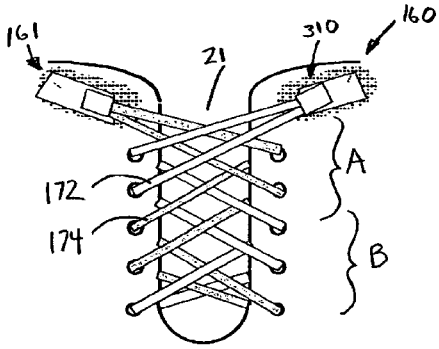
FIG. 7E shows the lacing system of the present invention having two (2) lace loops and is in the fastened position.

FIG. 7D shows an embodiment of the present invention in the opened position, having one (1) lace loop 170, and five (5) eyelets on either side. Fixed fasteners 184, 183 are hook and loop type locking tape, however, they could be any other type of fasteners that engage with the movable fasteners 160,161. When the users pulls the movable fasteners outwards, away from the shoe, in the direction of arrows C and D, the bottom B, of the adjustable opening contracts. Then, as the user crisscross the movable fasteners (in 2 overlapping arcs), to fasten them (as in FIG. 7E) and the top area A of the adjustable opening contracts. Therefore in one set of circular motions the entire length of the adjustable contracts. FIG. 7E shows the adjustable opening having two (2) lace loops 172,174. FIGS. 7E benefits runners because it leaves a small area 21 in front of the ankle to allow it to flex.

Figure 7F:
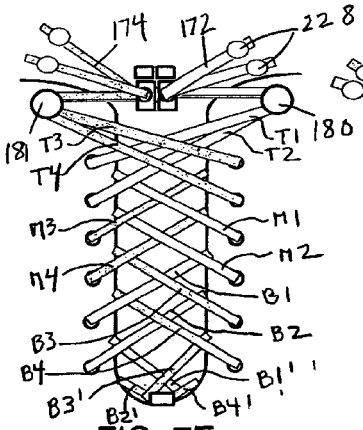
FIG. 7F shows the lacing system of the present invention having two (2) movable fasteners, and two (2) lace loops, six (6) pairs of eyelets fastened by cord-locks that attach to each other in the center.
Figure 7G:
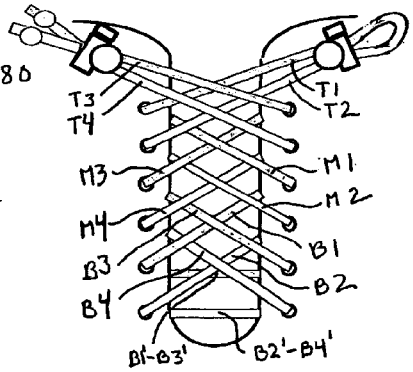
FIG. 7G shows the lacing system of the present invention having two (2) lace loops formed by cord-locks that hook onto hooks on each side of the opening.
Figure 7H:
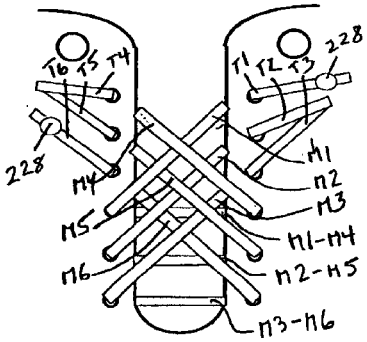
FIG. 7H shows the lacing system of the present invention having one (91) lace loop, three (3) lace segments extending from either side, and six (6) pairs of eyelets.

FIGS. 7F–H show three (3) embodiments of the lacing system of the present invention which have 6 pairs of eyelets in the adjustable opening. FIG. 7F shows the lacing system having hooks 180,181 on top and two (2) lace loops 172, 174. The movable fasteners are two (2) cord-locks 222 that attach to each other in the center of the opening and fix the size of the loops. This embodiment benefits the user because no adjustment is required after initial installation. The user just hooks and unhooks the cords-locks. FIG. 7G shows a lacing system of the present invention with two (2) lace loops 172,174. This embodiments can also easily be installed by the user as as after market lacing system. The cord-locks squeeze the loop at four (4) places creating two (2) closed loops. FIG. 7H shows the lacing system of the present invention, having one open lace loop 170 forming having three (3) lace segments extending from each movable fasteners (not shown).

FIGS. 8A–8C show the lacing system of the present invention on several different articles of manufacture. FIG. 8A shows the lacing system of the present invention on an arm brace. The segments 1,2,3,4 formed by lace loop 170 radiate or extend from the strap or movable fastener 160. The entire arm brace or bandage contracts at once, when the strap is pulled. The far (or bottom) part contracts first, when the user pulls the fastener up, and then the middle and near (or top) part contracts, when the user pulls the movable fastener in an arc to fasten it. The arm brace opens wide for the hand to be inserted (or removed) and the user can adjust the tension himself using the non-injured hand. FIG. 8B shows the lacing system of the present invention on a pair of pants having one (1) lace loop 170 and two (2) movable fasteners 160, 161 on the waist. FIG. 8C shows the lacing system of the present invention on a corset or body brace. If the brace has the opening in the back, the user simply pulls both strap ends 160, 161 towards the front, to secure the entire opening of the brace.

The lacing system could of course be used on other orthopedic devices, on luggage, corsets, or other devices having an opening whose size is adjustable, etc. and could be configured in many other ways by someone skilled in the art. After studying the disclosure of the present invention as a whole, many other lacing embodiments could be contrived by those skilled in the art.

The lacing system of the present invention provides the user with 1) the comfort, fit, and appearance of conventional laces; 2) the ease, speed, and safety of hook-and-loop fasteners; and 3) the strength, reliability, and durability, of a ratcheted ski boot buckle. Depending upon the lacing system embodiment and the fastener used, this lacing system has further benefits for different population segments. The hook-and-loop fastener is advantageous for seniors as well as young children because of its' ease of use. The buckle fastener is advantageous for athletes because of its' strength, reliability, and durability and a positive lock.

Thus, while there have been shown, described, and pointed out, fundamental novel features of the invention as applied to the preferred embodiment thereof, it will be understood that various omissions, substitutions, and changes in the form and details of the devices illustrated, and in their operation, may be made by those skilled in the art without departing from the spirit and scope of the invention. For example it is expressly intended that all combinations of those elements and/or steps which perform substantially the same function, in substantially the same way, to achieve the same results are within the scope of this invention. Substitutions of elements from one described embodiment to another are also fully intended and contemplated. It is also to be understood that the drawings are not necessarily drawn to scale, but that they are merely conceptual in nature. It is the intention, therefore, to be limited only as indicated by the scope of the claims appended hereto.

What is claimed is:

1. A lacing system for a shoe comprising:

(a) at least one lace loop;

(b) at least three lace segments formed from said at least one lace loop, said at least three lace segments having at least three top segments, at least three middle segments, and at least two bottom segments;

(c) an adjustable opening defined by first side, a second side, a top, and a bottom; wherein said adjustable opening has an unfastened position and a fastened position;

(d) a moveable fastener, wherein said at least three top segments extend from said movable fastener to said first side;

(e) and wherein said at least three middle segments extend said first side to said second side;

(f) a gap at said top of said adjustable opening, said gap formed by one segment of said at least three middle segments that traverses diagonally downward from said first side to said second side, and said second side of said adjustable opening;

(g) and wherein, in said fastened position, said at least three top segments cover said gap and cross over at least one of said at least three middle segments in said adjustable opening;

(h) and wherein said at least two bottom segments extend from said second side to said first side again, thereby traversing said adjustable opening, and criss-crossing at least one of said at least three middle segments in said adjustable opening;

(i) a fixed fastener disposed on said shoe, whereby pulling said movable fastener towards said fixed fastener causes contraction of substantially all of said adjustable opening; and (j) said fixed fastener is engagable with said movable fastener to maintain said contraction of said adjustable opening in said fastened position.

2. A lacing system according to claim 1, wherein one of said movable fastener and fixed fastener includes locking tape.

3. A lacing system according to claim 1, wherein one of said movable fastener and said fixed fastener includes a hook.

4. A lacing system according to claim 1, wherein one of said movable fastener and said fixed fastener includes teeth.

5. A lacing system for a shoe comprising:

(a) at least one lace loop;

(b) said at least one lace loop forming a first set of at least two lace segments having first top segments, first middle segments, and first bottom segments, and a second set of at least two lace segments having second top segments, second middle segments, and second bottom segments;

(c) an adjustable opening defined by first side, a second side, a top, and a bottom; said adjustable opening having a fastened position and an unfastened position;

(d) a first movable fastener, wherein said first top segments extend from said first movable fastener to said first side;

(e) a second movable fastener, wherein said second top segments extend from said second movable fastener to said second side;

(f) and wherein said first middle segments extend from said first side to said second side traversing said adjustable opening;

(g) and wherein said second middle segments extend from said second side to said first side traversing said adjustable opening;

(h) and wherein said first bottom segments extend from said second side, traversing said adjustable opening towards said first side again;

(i) and wherein said second bottom segments extend from said first side, traversing said adjustable opening, towards said second side again;

(j) a gap, formed at said top of said adjustable opening, by one segment of of said first middle segments, one segment of said second middle segments, said first side, and said second side, when in said unfastened position;

(k) at least one of said first top segments and said second top segments cover said gap, in said fastened position;

(l) whereby pulling on said first movable fastener and pulling on said second movable fastener causes contraction of substantially all of said adjustable opening; and (m) said first movable fastener and said second movable fastener are engagable to maintain said contraction of said adjustable opening in said fastened position.

6. A lacing system according to claim 5, wherein at least one of said first movable fastener and said second movable fastener includes locking tape.

7. A lacing system according to claim 5, wherein at least one of said first movable fastener and said second movable fastener includes a cord-lock.

8. A lacing system according to claim 5, wherein at least one of said first movable fastener and said second movable fastener engages with a hook.

9. A lacing system according to claim 5, wherein said first movable fastener engages with said second fastener in said fastened position.

10. A lacing system according to claim 9, further including at least one fixed fastener disposed on said shoe, wherein said first movable fastener engages with said at least one fixed fastener in said fastened position.

11. A lacing system for an article of manufacture comprising:

(a) at least one lace loop;

(b) at least three lace segments formed from said at least one lace loop, said at least three lace segments having at least three top segments, at least three middle segments, and at least two bottom segments;

(c) an adjustable opening defined by first side, a second side, a top, and a bottom; wherein said adjustable opening has an unfastened position and a fastened position;

(d) a moveable fastener, wherein said at least three top segments extend from said movable fastener to said first side;

(e) and wherein said at least three middle segments extend said first side to said second side;

(f) a gap at said top of said adjustable opening, said gap formed by one segment of said at least three middle segments that traverses diagonally downward from said first side to said second side, and said second side of said adjustable opening;

(g) and wherein, in said fastened position, said at least three top segments cover said gap and cross over at least one of said at least three middle segments in said adjustable opening;

(h) and wherein said at least two bottom segments extend from said second side to said first side again, thereby traversing said adjustable opening, and criss-crossing at least one of said at least three middle segments in said adjustable opening;

(i) a fixed fastener disposed on said article of manufacture, whereby pulling said movable fastener towards said fixed fastener causes contraction of substantially all of said adjustable opening; and (j) said fixed fastener is engagable with said movable fastener to maintain said contraction of said adjustable opening in said fastened position.

12. A lacing system according to claim 11, wherein one of said movable fastener and fixed fastener includes locking tape.

13. A lacing system according to claim 11, wherein one of said movable fastener and said fixed fastener includes a hook.

14. A lacing system according to claim 11, wherein one of said movable fastener and said fixed fastener includes teeth.

15. A lacing system for an article of manufacture comprising:

(a) at least one lace loop;

(b) said at least one lace loop forming a first set of at least two lace segments having first top segments, first middle segments, and first bottom segments, and a second set of at least two lace segments having second top segments, second middle segments, and second bottom segments;

(c) an adjustable opening defined by first side, a second side, a top, and a bottom; said adjustable opening having a fastened position and an unfastened position;

(d) a first movable fastener, wherein said first top segments extend from said first movable fastener to said first side;

(e) a second movable fastener, wherein said second top segments extend from said second movable fastener to said second side;

(f) and wherein said first middle segments extend from said first side to said second side traversing said adjustable opening;

(g) and wherein said second middle segments extend from said second side to said first side traversing said adjustable opening;

(h) and wherein said first bottom segments extend from said second side, traversing said adjustable opening towards said first side again;

(i) and wherein said second bottom segments extend from said first side, traversing said adjustable opening, towards said second side again;

(j) a gap, formed at said top of said adjustable opening, by one segment of of said first middle segments, one segment of said second middle segments, said first side, and said second side, when in said unfastened position;

(k) at least one of said first top segments and said second top segments, cover said gap, in said fastened position;

(l) whereby pulling on said first movable fastener and pulling on said second movable fastener causes contraction of substantially all of said adjustable opening; and (m) said first movable fastener and said second movable fastener are engagable to maintain said contraction of said adjustable opening in said fastened position.

16. A lacing system according to claim 15, wherein at least one of said first movable fastener and said second movable fastener includes locking tape.

17. A lacing system according to claim 15, wherein at least one of said first movable fastener and said second movable fastener includes a cord-lock.

18. A lacing system according to claim 15, wherein at least one of said first movable fastener and said second movable fastener engages with a hook.

19. A lacing system according to claim 15, wherein said first movable fastener engages with said second fastener in said fastened position.

20. A lacing system according to claim 19, further including at least one fixed fastener disposed on said article of manufacture, wherein said first movable fastener engages with said at least one fixed fastener in said fastened position.

* * * * *